US007552548B2

(12) United States Patent
Ikegami

(10) Patent No.: US 7,552,548 B2
(45) Date of Patent: Jun. 30, 2009

(54) RESIN SAFETY SHOE TOE CAP

(75) Inventor: Isao Ikegami, Kurobe (JP)

(73) Assignee: YKK Corporation, Tokyo (JP)

( * ) Notice: Subject to any disclaimer, the term of this patent is extended or adjusted under 35 U.S.C. 154(b) by 484 days.

(21) Appl. No.: 11/408,309

(22) Filed: Apr. 21, 2006

(65) Prior Publication Data

US 2007/0068044 A1 Mar. 29, 2007

(30) Foreign Application Priority Data

Sep. 28, 2005 (JP) ..... 2005-281035

(51) Int. Cl.
*A43C 13/14* (2006.01)

(52) U.S. Cl. ..... 36/77 R

(58) Field of Classification Search ..... 36/77 R, 36/77 M

See application file for complete search history.

(56) References Cited

U.S. PATENT DOCUMENTS 5,809,666 A * 9/1998 Harwood ..... 36/77 R
6,907,681 B2 * 6/2005 Tanaka et al. ..... 36/77 R
7,062,868 B2 * 6/2006 Frulla ..... 36/77 R
2006/0213086 A1 * 9/2006 Ching ..... 36/77 R

FOREIGN PATENT DOCUMENTS

| | | |
|---|---|---|
| DE | 20018977 | 3/2001 |
| EP | 0 100 181 | 2/1984 |
| GB | 2071989 A * | 9/1981 |
| JP | UM-60-98408 | 7/1985 |
| JP | UM-7-16603 | 3/1995 |
| JP | A-9238708 | 9/1997 |
| JP | UM-2598209 | 6/1998 |
| JP | A-11056410 | 3/1999 |
| JP | 2004-41406 | 2/2004 |

* cited by examiner

*Primary Examiner*—Ted Kavanaugh
(74) *Attorney, Agent, or Firm*—Alston & Bird LLP

(57) ABSTRACT

A resin safety shoe toe cap, formed of a fiber-free thermoplastic resin and comprising a front end upright portion, a big toe upright portion, a little toe upright portion, a top portion, and a bottom portion, wherein: (a) outer wall surfaces of the respective upright portions are formed so as to rise substantially vertically to the bottom portion; (b) an inner wall surface of the front end upright portion is curved, and the inner wall surface opposed to the vertical surface of the outer wall is thicker at a top portion side than at a bottom portion side; and (c) the front end upright portion is formed to be thicker in thickness than the little toe upright portion and the big toe upright portion. The shoe toe cap is reduced as much as possible in weight and yet meets safety standards for shoe toe caps.

4 Claims, 4 Drawing Sheets

SECTION A-A

SECTION B-B

SECTION C-C

SECTION D-D

SECTION E-E

RESIN SAFETY SHOE TOE CAP

BACKGROUND OF THE INVENTION

1. Field of the Invention

The present invention relates to safety shoe toe caps that are applied to shoes, boots or the like to structurally reinforce the shoe toes, thereby enhancing their safety.

2. Description of the Prior Art

Regarding the toe caps in safety shoes, a great importance has hitherto been attached to the strength of the part at the upper of shoes for the protection against the dropping of a heavy material, and hence steel toe caps have been put to practical use. Since, however, safety shoes with steel toe caps are heavy, there occurs a problem with the workability of a person wearing such shoes. For this reason, in recent years, to make safety shoes lighter, toe caps made of a thermoplastic resin reinforced with reinforcing fibers, such as glass fibers, have thus been developed.

As an example of the above-described safety shoe toe cap made of thermoplastic resin, reinforced with glass fibers or other reinforcing fibers, there is that disclosed in Japanese Patent Publication No. 2004-41406A. This publication discloses a safety shoe toe cap, with which the structural form is defined to meet the impact resistance and compression resistance performance requirements stipulated for safety shoe standards in Japanese Industrial Standards JIS T 8101 (grade L, grade S, and grade H standards) and in the unified European Standards, CEN Standards. However, though the fiber reinforced safety shoe toe cap enables a shoe toe cap of thin shape to be manufactured, it is high in manufacturing cost.

Meanwhile, DE200118977U1 discloses an example of a metal-free, fiber-free synthetic resin safety shoe toe cap that is made neither of steel nor of fiber-reinforced thermoplastic resin. This publication discloses a safety shoe toe cap that uses a fiber-free synthetic resin and, by prescribing the structure and the dimensions, meets the impact resistance and compression resistance performance requirements prescribed in safety shoe standards of DIN EN 12568. However, for the safety shoe toe cap of this publication to meet the performance requirements, the respective portions must be made high in thickness and the safety shoe thus becomes heavy. For example, the thickness of a toe portion is 9 to 12 mm (see claim 4 of the same Document). In regard to cost, the material cost is made correspondingly high and the cost is thus high.

SUMMARY OF THE INVENTION

An object of this invention is to provide a shoe toe cap, formed of fiber-free thermoplastic resin, that is reduced as much as possible in weight and yet meets safety standards for shoe toe caps.

In order to achieve the above object, this invention provides the following arrangements.

(1) A resin safety shoe toe cap, formed of a fiber-free thermoplastic resin and comprising a front end upright portion, a big toe upright portion, a little toe upright portion, a top portion, and a bottom portion, wherein:

(a) outer wall surfaces of the above-described respective upright portions are formed so as to rise substantially vertically to the bottom portion;

(b) an inner wall surface of the above-described front end upright portion is curved and the inner wall surface opposed to the vertical surface of the outer wall is thicker at a top portion side than at a bottom portion side; and (c) the front end upright portion is formed to be thicker in thickness than the little toe upright portion and the big toe upright portion.

(2) The safety shoe toe cap according to (1) above 1, wherein the vertical portion of the above-described front end upright portion is formed to be continuous with the vertical surfaces of the little toe upright portion and the big toe upright portion.

(3) The safety shoe toe cap according to (1) or (2) above, wherein the inner wall surface of the front end upright portion is formed so as to thicken gradually from the bottom portion toward the top portion and when a normal to an inner wall surface portion that rises vertically to the bottom portion is taken as being at 0°, the angle of the inner wall surface at a height of ½ of a total height is no less than 80° and no more than 90°.

(4) The safety shoe toe cap according to any of (1) through (3) above, wherein the thickness of the front end upright portion is greater than the thickness of each of the other upright portions and is 6 to 8 mm.

(5) The safety shoe toe cap according to any of (1) through (4) above, wherein the vertical portion of the outer wall surface of the front end upright portion is formed to be no less than ⅖ of the total height.

(6) The safety shoe toe cap according to any of (1) through (5), wherein the vertical portion of the above-described front end upright portion is formed across a range of no less than 15° to the left and the right of a center of the front end upright portion.

DETAILED DESCRIPTION OF THE PREFERRED EMBODIMENTS

Figure 1:
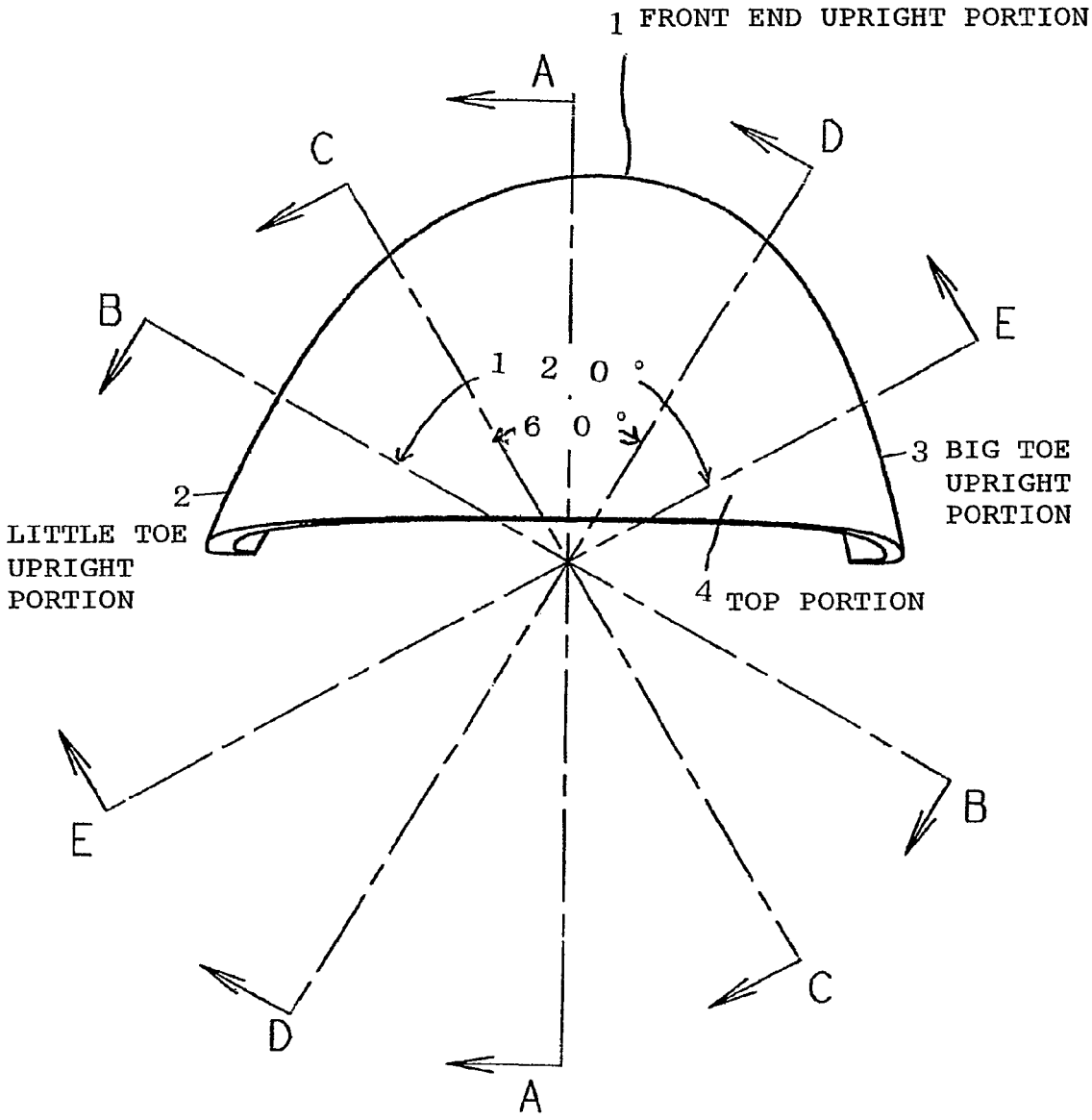
FIG. 1 is a plan view of an embodiment according to this invention and shows the positions of the respective sections.

With this invention, a resin with impact resistant characteristics, such as a polyamide or a polycarbonate, is used to obtain a predetermined strength even though being fiber-free, and by arrangement of the shape of the shoe toe cap, the shoe toe, at which a load is applied most readily, is reinforced with emphasis. In accompaniment, arrangements are made so that the load applied to the shoe toe cap is dispersed uniformly among the little toe upright portion and the big toe upright portion to thereby reduce excess thickness and make the shoe toe cap lightweight as a whole.

That is, by forming the inner wall surface of the front end upright portion so that it thickens gradually, the curvature of the curved surface portion that is the portion of connection of the front end upright portion and the top portion is smoothened, thereby preventing a stress load from being applied in a localized manner. That is, when the normal to the portion that rises vertically from the bottom portion is taken as being at 0°, by making the angle x of the inner wall surface at a height that is ½ the total height be no less than 80° and no more than 90°, a structure can be realized with which the stress load applied to the inner wall surface can be dispersed as much as possible and a buckling height can be secured as well. If the above-described angle is less than 80°, it becomes difficult to secure a gap that enables the entry of a front end of a foot and the product becomes thick and heavy. Oppositely, if the above-described angle exceeds 90°, the buckling surface becomes positioned at a low position when a stress is applied to the top portion and it becomes difficult to secure a residual buckling height.

Also by making the thickness of the range of the vertical surface of the front end upright portion greater than the thickness of the vertical surface of the other upright portions and be 6 to 8 mm, the shoe toe cap can be made to have a thin shape overall. Furthermore, by forming the vertical portion of the outer wall surface of the front end upright portion to be no less than ⅖ and preferably no less than ⅗ of the total height, the buckling height necessary for satisfying various standards can be secured. Since the outer wall surface of the front end upright portion is formed across a range of no less than 15° to the left and the right of the center of the front end upright portion, that is, across a range of a central angle of no less than 30°, a strength, necessary for bearing the load when a stress is applied to the top portion, can be secured. When the central angle is less than 30°, the necessary strength cannot be obtained. The central angle is preferably and suitably in the range of 60 to 120°. When 120° is exceeded, the shape becomes such that wearing is made difficult.

This invention can provide a fiber-free, thermoplastic synthetic resin toe cap, which, though being lightweight, meets the impact resistance and compression resistance performances for grade L, grade S, and grade H safety shoe standards stipulated in Japanese Industrial Standard JIS T 8101 and the impact resistance and compression resistance performances stipulated in the safety shoe standard EN12568 (15KN, 10KN) of unified European Standards, CEN standards.

This invention can provide a product, which, despite being lightweight, is excellent in impact resistance and compression resistance and, despite being a fiber-free, thermoplastic synthetic resin shoe toe cap, can satisfy both the Japanese standards and the unified European standards.

A specific embodiment of this invention shall now be described based on the drawings.

As a material for forming a product according to this invention, a polycarbonate or a polyamide of excellent impact resisting and absorbing characteristics is used.

FIG. 1 is a plan view of an embodiment with 1 indicating a front end upright portion, 2 indicating a little toe upright portion, 3 indicating a big toe upright portion, and 4 indicating a top portion. A, B, C, D, and E indicate respective cross-section positions. With respect to line A-A at a center, line C-C and line D-D are at positions of 30° to the left and right and line B-B and line E-E are at positions of 60° to the left and right, from line A-A.

Figure 2:
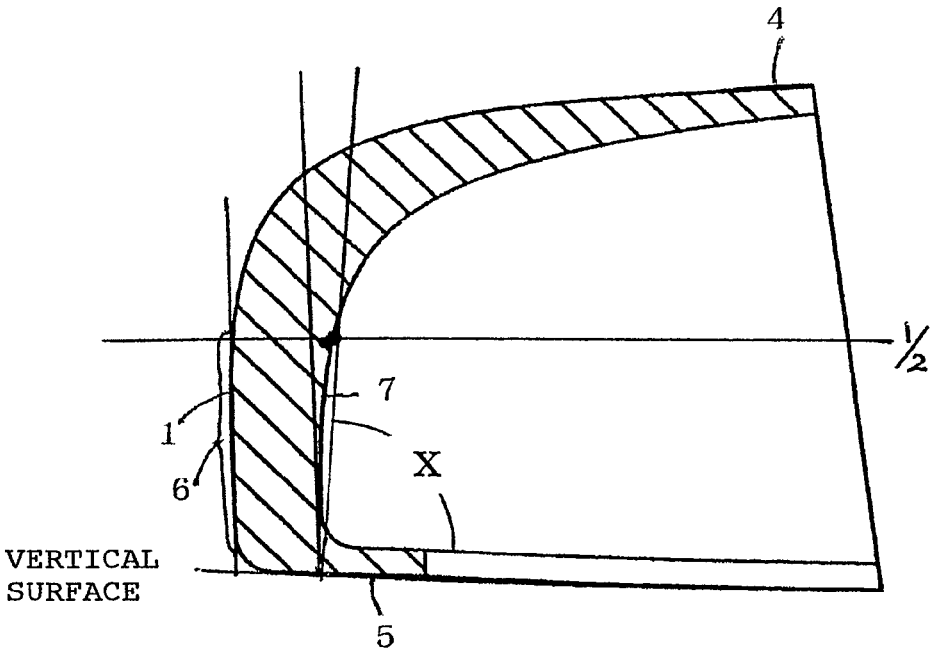
FIG. 2 is a sectional view taken on line A-A of FIG. 1.

FIG. 2 is a sectional view taken on line A-A, and an outer wall surface of front end upright portion 1 is a substantially vertical surface 6. This surface is not necessarily completely vertical and there is some range of tolerance. An inner wall surface 7 at the opposite side has a somewhat curved shape, with a top portion 4 side being formed to be thicker in thickness than a bottom portion 5 side. This shape is preferably such that when the normal to the portion of inner wall surface 7 of the front end upright portion 1 that is vertically erect with respect to bottom portion 5 is set as 0°, the angle x of the inner wall portion at a height of ½ of a total height is no less than 80° and no more than 90°.

It is sufficient for bottom portion 5 to have the minimum width and thickness for supporting a vertical load.

Figure 4:
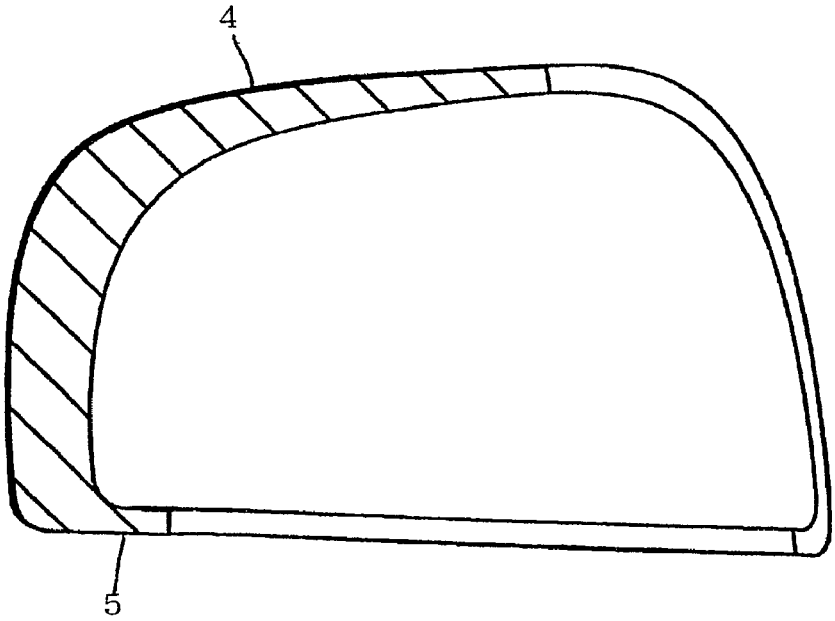
FIG. 4 is a sectional view taken on line C-C of FIG. 1.

FIG. 4 is a sectional view taken on line C-C, and a front end upright portion 1 extends to a position of 30° from the center of the front end. A vertical surface 6 is slightly shorter here than at the position of FIG. 2.

Figure 3:
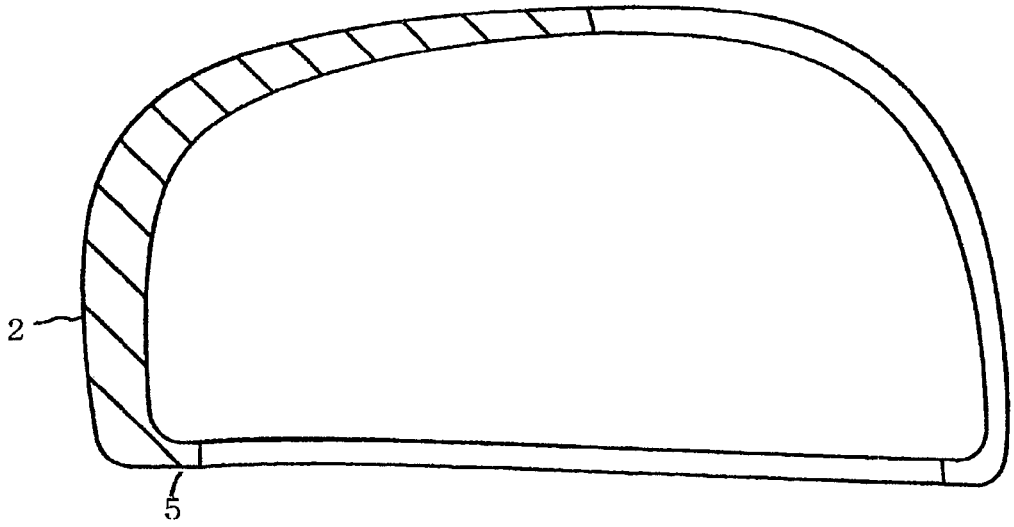
FIG. 3 is a sectional view taken on line B-B of FIG. 1.

FIG. 3 is a sectional view taken along line B-B, and the thickness of the little toe upright portion 2 is thinner in thickness than the front end upright portion 1 shown in FIG. 2. That is, the necessary strength is secured mostly at the front end upright portion and the little toe upright portion 2 is reduced considerably in thickness to achieve a reduction in weight.

Figure 7:
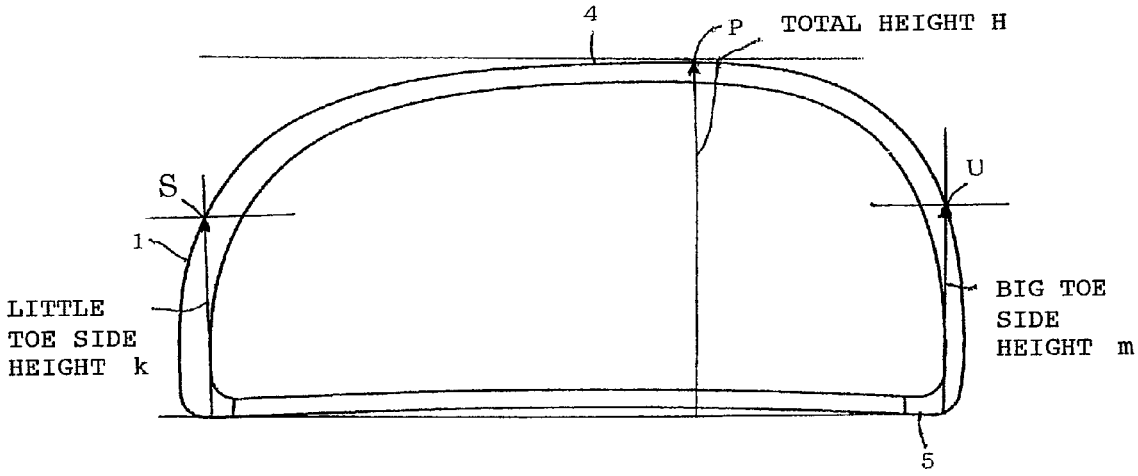
FIG. 7 is a front view as viewed from the rear of the embodiment according to this invention.

Preferably, a little toe side height of the little toe upright portion is no less than ½ of the total height. FIG. 7 shows how the little toe side height is measured. The total height H is defined as the vertical distance from the bottom portion 5 surface to a top point P of the top portion 4, a line tangent to the inner wall surface 7 of the little toe upright portion 2 and vertical to the bottom surface 5 is drawn, an intersection S of this line with the outer wall surface of the little toe upright portion 2 is determined, and the little toe side height k is defined as distance along this vertical line between the above-described intersection S and bottom surface 5.

Figure 5:
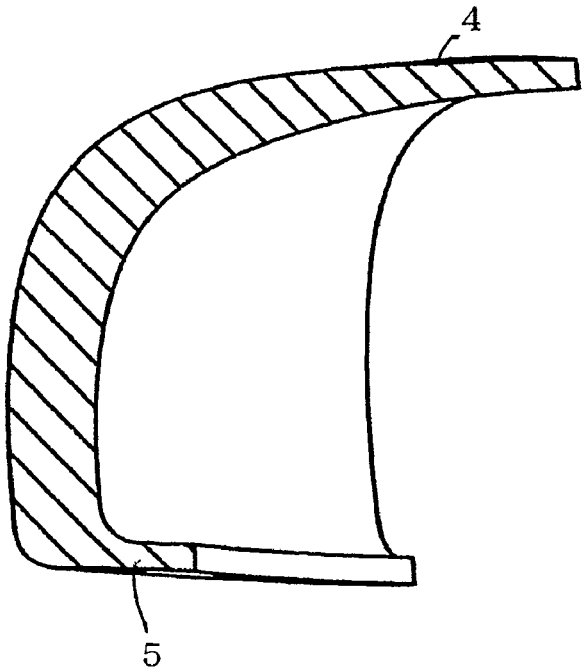
FIG. 5 is a sectional view taken on line D-D of FIG. 1.
Figure 6:
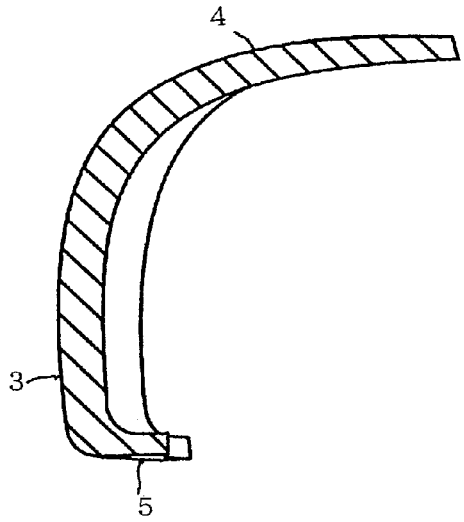
FIG. 6 is a sectional view taken on line E-E of FIG. 1.

FIG. 5 is a sectional view taken on line D-D and is substantially the same as the above-described sectional view take on line C-C of the little toe side. FIG. 6 is a sectional view taken on line E-E and though it is substantially the same as the above-described sectional view take on line B-B of the little toe side, a big toe side height, measured in a manner similar to the little toe side height, is changed slightly from the above-described little toe side height.

That is, as shown in FIG. 7, when viewed from the center of the toe cap, in other words, when the toe cap is viewed from the rear, the intersection P of the total height H and the outer wall of the top portion lies at the big toe side of the center between the little toe upright portion and the big toe upright portion, and when U is the intersection of a vertical line, which is drawn on the inner wall so as to be vertical to the bottom portion 5 at the big toe side, and the outer wall of the big toe side, the position of U is higher than the height of the above-described S. That is, the big toe side height m must be greater than the little toe side height k. If the position of U is not higher than the position of S, a large part of the stress load is applied to the big toe upright portion, and the stress is thus not dispersed adequately and the strength of the toe cap becomes weak.

What is claimed is:

1. A resin safety shoe toe cap, formed of a fiber-free thermoplastic resin and comprising a front end upright portion, a big toe upright portion, a little toe upright portion, a top portion, and a bottom portion, wherein:

(a) outer wall surfaces of the respective upright portions are formed so as to rise substantially vertically to the bottom portion;

(b) an inner wall surface of the front end upright portion is curved, and the inner wall surface opposed to the vertical surface of the outer wall is thicker at a top portion side than at a bottom portion side, wherein the inner wall surface of the front end upright portion is formed so as to thicken gradually from the bottom portion toward the top portion and when a normal to an inner wall surface portion that vertically rises with respect to the bottom portion is taken as being at 0°, the angle of the inner wall surface at a height of ½ of a total height is no less than 80° and no more than 90°;

(c) the front end upright portion is formed to be thicker in thickness than the little toe upright portion and the big toe upright portion and is 6 to 8 mm; and (d) a vertical portion of the outer wall surface of the front end upright portion is formed to be no less than ⅖ of the total height.

2. The safety shoe toe cap according to claim 1, wherein the vertical portion of the front end upright portion is formed to be continuous to the vertical surfaces of the little toe upright portion and the big toe upright portion.

3. The safety shoe toe cap according to claim 1, wherein the vertical portion of the front end upright portion is formed across a range of no less than 15 degree to the left and the right of a center of the front end upright portion.

4. The safety shoe top cap according to claim 1, wherein an intersection of a vertical line, which is drawn on the inner wall surface of the front end upright portion so as to be vertical to the bottom portion at the front end side, with the outer wall surface of the front end upright portion is at a higher position than both an intersection of a vertical line, which is drawn on the inner wall surface of the little toe upright portion so as to be vertical to the bottom portion at the little toe side, with the outer wall surface of the little toe upright portion and an intersection of a vertical line, which is drawn on the inner wall surface of the big toe upright portion so as to be vertical to the bottom portion at the big toe side, with the outer wall surface of the big toe upright portion.

* * * * *